United States Patent [19]

Staab

[11] Patent Number: 4,611,720

[45] Date of Patent: Sep. 16, 1986

[54] DISPLAY RACK SYSTEM FOR CANDLES

[75] Inventor: Robert J. Staab, Maineville, Ohio

[73] Assignee: Lancaster Colony Corporation, Columbus, Ohio

[21] Appl. No.: 600,097

[22] Filed: Apr. 13, 1984

[51] Int. Cl.[4] ..... A47F 7/00

[52] U.S. Cl. ..... 211/60.1; 211/184

[58] Field of Search ..... 211/60.1, 71, 59.4, 211/68, 69, 69.1, 184; 248/448, 460, 441.1, 205.3

[56] References Cited

U.S. PATENT DOCUMENTS

| | | | |
|---|---|---|---|
| 584,167 | 6/1897 | Shanklin | 211/184 X |
| 660,264 | 10/1900 | Storm | 211/42 X |
| 673,200 | 4/1901 | Delbridge | 211/184 |
| 1,415,110 | 5/1922 | Pearl | 211/184 X |
| 1,712,054 | 5/1929 | Sheard | 211/184 X |
| 1,736,574 | 11/1929 | Binks | 211/184 X |
| 1,921,222 | 8/1933 | DeLamar | 211/71 |
| 1,973,188 | 9/1934 | Verderber | 211/70.6 |
| 2,222,974 | 11/1940 | Bow | 211/184 X |
| 2,625,806 | 1/1953 | Kennedy | 211/184 X |
| 3,455,462 | 7/1969 | Morgan | 211/42 |
| 4,454,948 | 6/1984 | Spamer | 211/59.2 |
| 4,476,986 | 10/1984 | Robinson | 211/184 X |

FOREIGN PATENT DOCUMENTS

| | | | |
|---|---|---|---|
| 1507242 | 11/1967 | France | 248/460 |

OTHER PUBLICATIONS

Candle-Lite 1983/84 Candle Selection Catalog, pp. 2, 3, Jan. 1983, Candle-Lite Company.

*Primary Examiner*—Ramon S. Britts
*Assistant Examiner*—Sarah A. Lechok Eley
*Attorney, Agent, or Firm*—Robert E. Stebens

[57] ABSTRACT

A merchandise display system is provided having a plurality of modular display racks adapted to be disposed in longitudinally aligned relationship and having a pair of elongated mounting ribs adapted to be disposed in longitudinally aligned relationship to the racks and to mechanically interconnect with the racks. The rails are adhesively secured to a supporting structure and fix the display racks with respect to that structure. Each display rack includes a generally horizontally disposed base support surface and an upstanding wall that is inclined rearwardly to form an upwardly opening, longitudinally extending V-shaped article supporting surface on which elongated articles of merchandise such as candles may be displayed in an upstanding position on the base support surface and reposed against the supporting wall. The base surface and supporting wall are formed with alternating rib and groove conformations that cooperate with the candles to prevent their displacement and cooperate with partition plates inserted in respective grooves in frictional engagement with spaced pairs of plates defining compartments for segregating of the different types of candles.

19 Claims, 5 Drawing Figures

DISPLAY RACK SYSTEM FOR CANDLES

FIELD OF THE INVENTION

This invention relates in general to merchandise display rack systems adapted for retail sales and designed specifically for the display of candles. It relates more particularly to a modular type display system in which a selected number of individual display modules are assembled into a linear display with the several modules maintained in assembled relationship by mechanical interlocking elements that also secure the assembly to a supporting structural shelf.

BACKGROUND OF THE INVENTION

Merchandising of candles in retail type stores requires a visual display of a large number and variety of candles to achieve effective sales volume. Candles are available in various diameters lengths and shapes as well as having the physical variety increased in number by variations in color and scents. Customer interest is greatly enhanced by a visual display of the entire line that a retail store has available and selection is substantially facilitated when the customer has a fully visible presentation, thereby providing ease of comparison as to the physical characteristics and color as well as permitting the customers to readily compare the scents.

Candle manufacturers customarily package candles of the conventional taper configuration in boxes of ten or twelve or other suitable number of candles as best determined by the particular physical characteristics of the specific candles. Retailers customarily display the candles either by placing opened boxes of the various types of candles on supporting shelving, thereby utilizing the boxing itself to maintain separation between the different candles or they utilize display shelving having partitioned shelves in which the candles are placed after removal from the respective boxes. To obtain a better visual display, retailers often employ shelving that is of an angled or inclined type in order to position the candles in an upwardly inclined position for better viewing. There is a practical limit to the extent that shelving is available for inclined display purposes and the suitability for such shelving to form a stable base for display of candles. From a sales standpoint it is desirable that the candles be displayed at a relatively steep angle to enable the customers to view the candles in a position that more nearly approximates the vertical position in which they are used.

Sales displays that merely utilize the shipping boxes in which the candles are received frequently result in a relatively uninteresting and ineffective display. Display of the candles in their packaging cartons or boxes inhibits visual observation of the candles and in general interferes with a customer's ability to compare the several candles and make a desired selection. Retail stores that utilize the more open display of partitioned shelving achieve a greater visual impact in their presentation. Shelving of this type normally comprises a shelf board such as that typically provided for use in conjunction with gondola type display racks and a number of partition plates of either metal or glass that are adapted to be removably secured to the supporting surface of the shelf. The shelf boards may be either adapted for mounting in a horizontal plane or at an incline for a more desirable vertical display of the candles. However, the partitioning in the form of the metal plates or glass plates require use of adapter fittings to secure and maintain the plates in the desired locations. The set up of such displays requires a considerable amount of time on the part of the stock clerks and while an improvement over the open box type displays, they still provide a less than optimum visual presentation for candles.

SUMMARY OF THE INVENTION

In accordance with this invention, a module type display system is provided for achieving a highly visible display of candles, particularly candles of the long taper type. The display system includes a selected number of modular display racks that are assembled into a linear array adapted to be positioned on a supporting shelf. Each of the modular display racks is formed with an article supporting surface configuration including a steeply inclined supporting wall and a slightly inclined base support surface that is uniquely adapted to maintain a quantity of candles in a substantially upright position for better viewing by the customers, although the candles are inclined rearwardly from the front of the display to obtain the desired stability for a continued neat appearance of the display. A pair of mounting rails are provided for mechanical interlocking with the several modular display racks to maintain them in the desired linearly assembled relationship as well as providing a convenient means of securing the system to a supporting shelf. Utilizing the candle display system of this invention enables stock clerks to quickly and easily set up a complete display of the store's line of candles. The stock clerk merely places the two rails on the supporting shelf at the desired position and secures them by adhesive tape strips carried on one surface of the rails and then positions the respective selected number of modular display racks onto the rail's in interlocking relationship. Each of the modular display racks is then provided with partition plates advantageously formed of clear plastic material that frictionally interfit into the candle supporting surfaces of the rack. The rack is configured to enable selective positioning of the partitions at any number of closely spaced positions to adapt the rack spacing to the amount of candles that are to be displayed for each of the various types as to physical characteristics, color or scent. The modular display rack in combination with the partition plates may be readily altered to conform to different volume requirements as sales dictate for any particular type or configuration of candle.

In accordance with this invention, each of the modular display racks is of a molded shell configuration and construction that is readily fabricated from plastic materials by suitable techniques such as molding or vacuum forming. Utilization of such construction results in a extremely sturdy but lightweight display rack. Utilizing a hollow shell type construction also permits the racks to be configured so that they can interfit in nested relationship for purposes of stacking and minimizing storage or transportation space requirements.

In addition to providing of the support rails for mechanical interlocking of a number of the racks in a linear display there is advantageously provided a connecting cover strip for the front wall that includes a pricing or identifying label rail and which performs the additional function of further securing the modular display racks in assembled relationship. This pricing or identifying label rail is of a molded plastic construction and secured by adhesive strips to a front wall portion of the several display racks that are assembled in linear relationship.

Using an elongated pricing rail that extends over several of the modular display racks results in further mechanical interconnection of the respective units. The rail incorporates a longitudinally extending C-shape slot or channel in which the pricing information printed on strips either of short or long length may be readily inserted. This price rail also performs the function of enhancing the appearance of the assembled units by covering the small gaps that exist between adjacent units, thereby resulting in a more continuous or integral appearance.

Also in accordance with this invention, the modular display rack is formed with a specific support surface configuration that is highly effective in maintaining elongated articles of merchandise such as candles in an upright position and an orderly appearing parallel arrangement. For this purpose, the supporting surfaces are formed with alternating ribs and grooves that extend transversely to the longitudinal axis of the modular rack and engage with the candles to maintain the candles in the desired orderly parallel arrangement. The display rack is also formed with a base supporting surface for engaging with the bottom ends of the candles and which is specifically configured to form a mechanical interlock with them and prevent sliding of the base of the candles along that surface. This base support surface configuration includes a series of notches or recesses formed in the ribs and extending longitudinally with respect to the display rack. A number of the notches are formed in spaced parallel relationship to cooperate with several of the candles that may be positioned within the particular space for a specific type of candle.

These and other objects and advantages of this invention will be readily apparent from the following detailed description of an illustrative embodiment of the display rack system and the accompanying drawings.

DESCRIPTION OF THE DRAWING FIGURES

DESCRIPTION OF THE ILLUSTRATIVE EMBODIMENT

Figure 1:
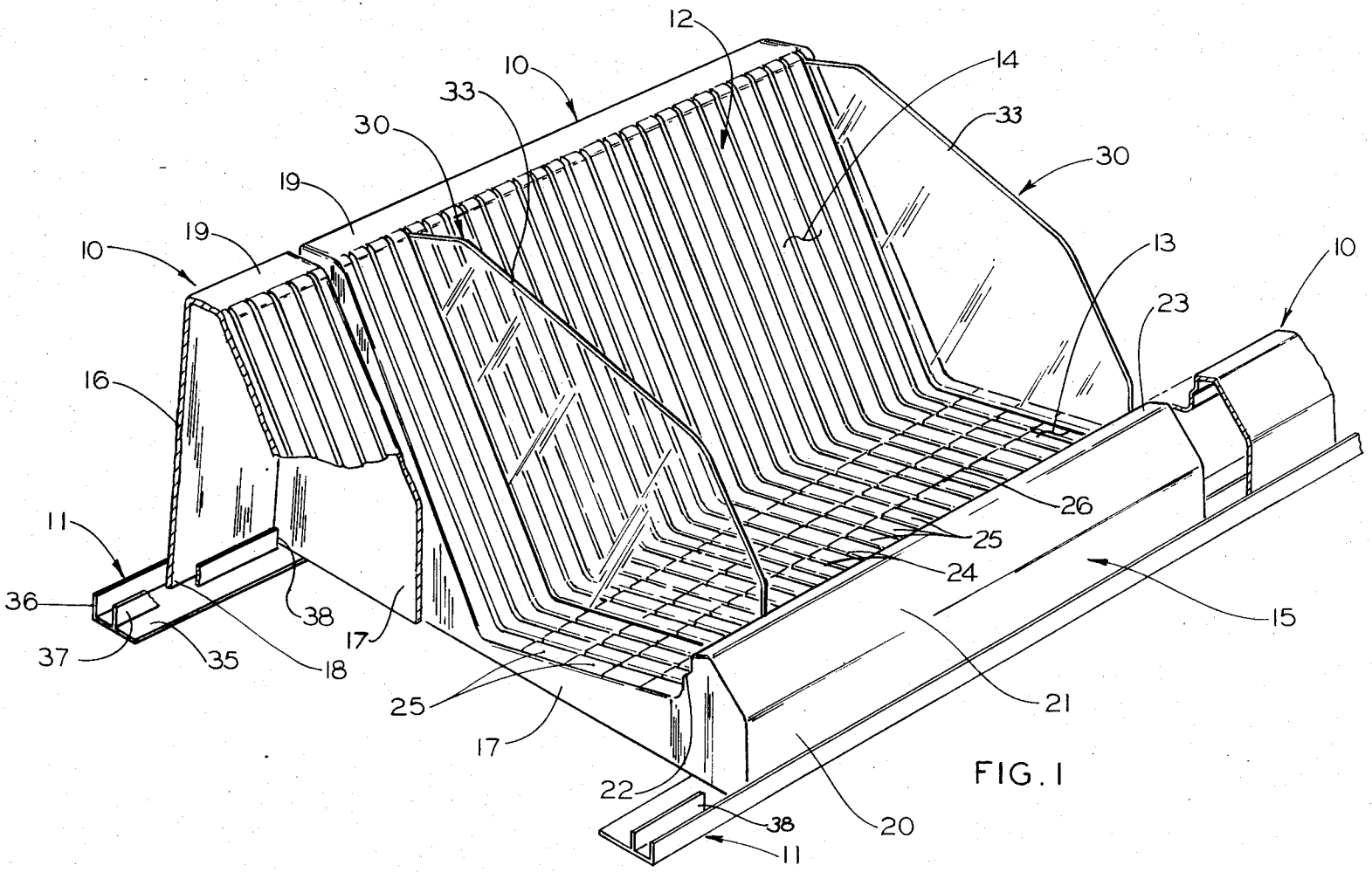
FIG. 1 is a perspective view of an embodiment of a merchandise display system of this invention including a modular display rack positioned in operative relationship with a pair of mounting rails.
Figure 2:
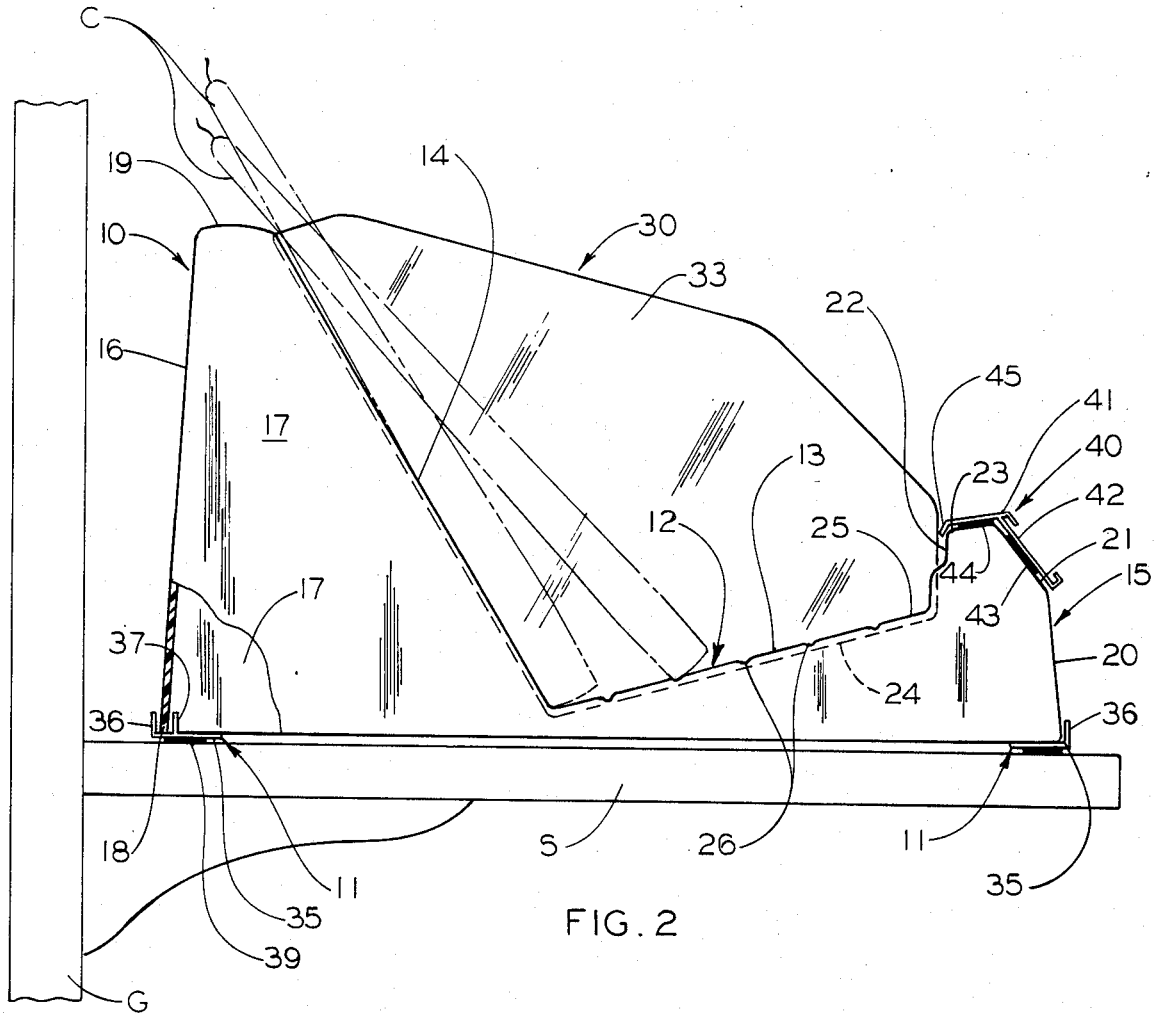
FIG. 2 is an end elevational view of a modular display rack and mounting rails positioned on a supporting shelf structure.

Having reference to the drawings, a display rack system for candles and embodying this invention is illustrated and is seen to comprise as its basic components a modular display rack 10 and a pair of elongated mounting rails 11. One display rack 10 is shown substantially in its entirety with fragmentary corner portions of two other racks of identical construction shown as in linearly assembled relationship to form a multiple rack display unit. FIG. 1 merely illustrates the display rack and mounting rail combination whereas that system is shown in FIG. 2 as mounted on a support shelf S that is secured to a vertical support standard of a conventional retail display gondola G. Also, in FIG. 2, two candles C are shown in phantom lines to illustrate the functioning of the display rack in the support and display of candles of the long taper type.

Each of the modular display racks 10 is advantageously formed from suitable synthetic resin or plastic materials by appropriate molding or vacuum forming techniques. The racks 10 are preferably of a shell type construction that is open at the bottom as can be observed by reference to FIG. 1.

Specific structural features and characteristics of a modular display rack of the invention can be most readily understood by reference to FIG. 1 although FIG. 2 also aids in illustrating the structure. As noted, each of the display racks 10 is of a shell type construction and includes structural wall elements that carry and support the article supporting surface which is specifically adapted to support and maintain taper configured candles. This article supporting surface designated by the numeral 12 comprises a base support surface 13 and an article supporting wall 14 that extends in upwardly projecting relationship to the base support surface. Each of the base support surface 13 and article supporting wall 14 are disposed in planes extending longitudinally of the display rack and are integrally formed, thereby defining an upwardly and forwardly opening V-shaped surface which is adapted to receive a number of taper type candles in supported relationship. It has been found in the construction of a display rack embodying this invention advantageous to orient the base support surface 13 in an upwardly inclined relationship to a horizontal plane with the article supporting wall 14 inclined relatively rearwardly from a vertical plane. This construction, as can be best seen in FIG. 2, enables the taper candles to repose in a rearwardly inclined position when supported on their base ends on the base support surface and reclining against the article supporting wall 14. In this illustrative embodiment, the base support surface 13 is disposed at a relatively shallow angle of the order of 15 degrees with respect to the horizontal while the article supporting wall 14 is disposed at a relatively steep angle of the order of 30 degrees with respect to a vertical plane. These specific angular relationships are noted as having been found particularly advantageous and the particular angle of each surface may be greater or less than that specifically noted provided the desired results can be obtained. The upwardly inclined base support surface provides a more secure mechanical engagement with the base ends of the candles to assist in maintaining them in the desired inclined position as shown in FIG. 2. The angle of the article supporting wall 14 provides a particularly advantageous viewing position for the candles as well as maintaining them in a relatively stable position for display purposes.

Structural support for the article supporting surface 12 is provided by several integrally formed wall elements which cooperatively define an upstanding peripheral wall and combine with the article supporting surface in forming the hollow shell structure. These supporting wall elements include a short front wall 15, a relatively high rear wall 16 and the two opposed end walls 17. The rear wall 16 merely comprises a flat planar sheet having a bottom longitudinally extending edge 18 which is adapted to rest on a mounting rail 11. The vertically extending panel of the rear wall 16 extends a distance upwardly terminating at an upper edge formed with an inturned or forwardly directed flange 19 that interconnects with the upper longitudinally extending edge of the article supporting wall 14. The front wall 15 includes a lower longitudinally extending panel 20 that is disposed in a substantially vertical plane and an upper section 21 comprising a longitudinally extending panel that is disposed in a rearwardly and upwardly inclined relationship to the lower section panel 20. Interconnecting the front wall 15 with the forward end of the base support surface 13 is a vertically extending longitudinally disposed wall 22 formed with a forwardly projecting and substantially horizontally disposed flange 23 that interconnects with the upper section of the front wall. The front wall lower panel 20 also has a bottom marginal edge portion that interfits in its respective rail 11. Each of the two end walls 17 comprise vertically disposed panels that are integrally formed with each of the front and rear walls 15, 16 and with the article supporting surface 12.

For purposes of minimizing storage requirements and transportation space for the display racks, it has been found advantageous to configure the display racks 10 so that they may be stacked in a nested or interfitting relationship. For that purpose, the front and rear walls 15, 16 are inclined slightly inward as can be best seen in FIG. 2 as are the end walls 17. This inward inclination of the end walls can be noted in FIG. 1 by observing that while the lower bottom edge of each of the end walls 17 and two adjacent display racks are disposed in closely adjacent relationship, there is a small space between the end walls at the top such as between the terminal ends of the flanges 19. Since the display rack is formed with a relatively thin shell, the inward inclination of the respective walls need not be of a great extent to permit stacking of the racks with the adjacent racks being interfitted or nested to the order of $\frac{2}{3}$ or $\frac{3}{4}$ of their vertical extent.

To enhance the ability of the display rack to support and maintain the taper type candles in a desired generally upstanding relationship and in orderly parallel relationship it has been found advantageous to form the article supporting surface 12 with a plurality of grooves or recesses 24 which extend transversely across the supporting surface with respect to the longitudinal axis of the display rack. These grooves or recesses 24 thus result in defining of a rib 25 between each pair of grooves. The grooves 24 extend fully across the base support surface 13 and article supporting wall 14 and also extend a distance upwardly along the wall 22 at the forward end. Each of the grooves 24 is of a width of the order of $\frac{1}{8}$ inch with the width of the ribs 25 being of the order of $\frac{3}{8}$ inch. The depth of the grooves 24 is also of the order of $\frac{1}{8}$ inch. To further enhance the ability of the display rack to maintain the candles in the desired orderly upright arrangement, the base support surface 13 is formed with a series of longitudinally extending notches 26. These notches are formed as shallow depressions in the upper surface portions of the respective ribs 25. In the illustrative embodiment, these notches 26 are formed in parallel rows that are spaced approximately one inch apart which results in forming of five rows of these notches. As can be best seen in FIG. 2, the function of these notches is to mechanically interengage with a corner edge of the base of a candle and thereby prevent its sliding upwardly along the base support surface to an extent greater than the next notch from the normal position of the candle. The grooves 24 also function to mechanically interengage with the cylindrical cross section candles that are disposed in a plane adjacent the article supporting wall 14 and thereby maintain those candles against displacement across the surface to an other than vertical orientation. Additional candles positioned in respective layers cooperate with the next rearward layer to be maintained in this position and restrained against tipping movement.

Figure 3:
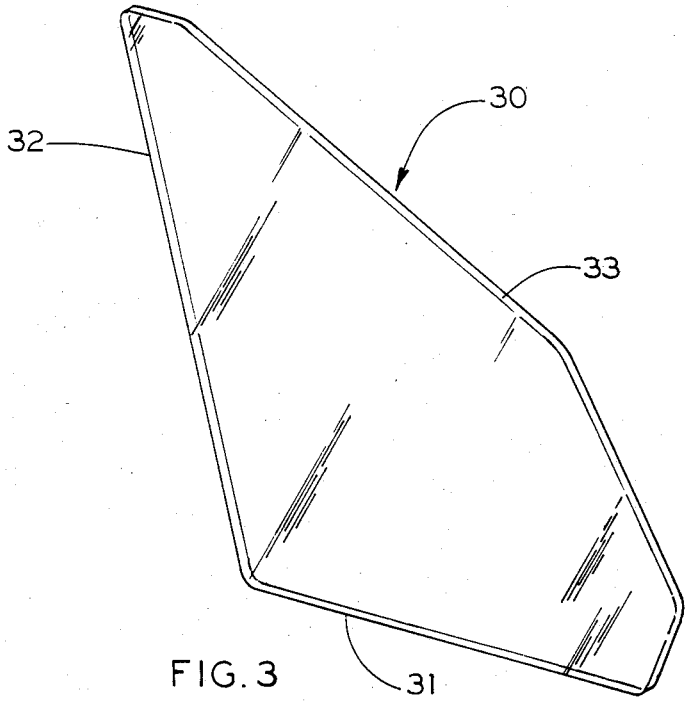
FIG. 3 is a perspective view of one of the partition or divider plates selectively positionable on the rack as shown in FIG. 1.

To further enhance the ability of the display rack 10 to maintain a visually pleasing display of a large number of candles of different physical characteristic as well as color and scent, it is preferred to provide the display rack with a number of partition plates 30 to form the desired number of compartments or sections to effectively separate and segregate the different types of candles. Each of the partition plates 30, one such plate being shown in perspective view in FIG. 3, is advantageously fabricated from a clear plastic material to enhance visibility of the display and minimize interfering effect of the partitions. Each of the partition plates is configured and of a thickness to interfit in a respective groove 24. As such, each partition plate 30 is formed with a bottom marginal edge 31 to interfit in a selected groove 24 formed in the base support surface 13 and an upwardly extending rear marginal edge portion 32 that iterfits in the groove formed in the article supporting wall 14. The width of the groove 24 and thickness of the plates 30 are controlled to result in a slight interference fit and thus a frictional interengagement between the plate and the side walls of the ribs that cooperate in defining the grooves. This frictional interference fit is sufficient to provide a mechanical interengagement to secure and maintain the plates 30 in a desired position. It will be noted that each of the plates 30 may be positioned in any one of the number of grooves 24 and thus readily enable the stock clerk to rearrange the display as to the relative size of any section or compartment for a particular type and style of candle. The partition plates 30 are formed to have a sufficient forward and upward extent such that they will be capable of maintaining a large quantity of candles in the selected section. It is preferred that the forward edge 33 of each plate be configured substantially as illustrated to provide a better appearance for the display although it will be apparent that the forward edge configuration may be modified as determined by particular visual appearances that may be desired or specific dimensional configurations of a particular display rack.

As previously noted, the display rack system of this invention comprises one or more of the modular display racks 10 and a pair of the elongated mounting rails 11. Each of the modular display racks 10 which is of a predetermined longitudinal length such as being of the order of one foot in length thus usually requires a number of such racks to be assembled in end-to-end linear alignment to accommodate the number and different types of candles that would normally be displayed in a retail store. To maintain the several display racks 10 in linear aligned relationship a pair of the elongated mounting rails 11 are provided to mechanically interconnect the respective display racks and to also provide a means of mechanically fixing the assembly on a supporting surface such as the shelf S of a display gongola G. Each of the two mounting rails 11 utilized with the several display racks is of identical construction although the orientation of the two rails is opposite as can be noted with respect to FIG. 1.

Each of the two mounting rails 11 may be advantageously formed as an extrusion of suitable plastic material having a base flange 35 formed with an upstanding vertical flange 36 along one edge. A vertical rib 37 is also integrally formed with the base flange 35 in spaced parallel relationship to the outer flange 36. The outer flange 36 and rib 37 are of essentially the same vertical height and cooperatively define a channel which is of a width sufficient to receive the bottom marginal edge portion of each of the respective ones of the front and rear walls 15, 16. The outer flange 36 is continuous throughout its length with the rail being of a sufficient length or a modular length adapted to accommodate a specified number of the modular display racks 10. The inwardly displaced vertical rib 37 is not continuous, but is provided with notches or spaces 38 at specified intervals to coincide with the end walls 17 of the display racks. Thus, the vertical rib 37 is formed in a number of segments having a length substantially equal to the internal longitudinal spacing between the end walls 17. Secured to the bottom surface of the base flange 35 is an elongated strip 39 of adhesive material adapted to secure the rails to a supporting surface. This adhesive strip 39 is of a commercially available type wherein the flat strip of adhesive as applied to the lower surface of the base flange 35 is covered with a protective sheet (not shown) that can be peeled off at the time it is desired to position and secure the rails to the supporting shelf. In assembling and positioning of the display system on a support shelf S, a stock clerk first places the two mounting rails 11 in the required spaced relationship to interfit with the bottom marginal edges of the respective front and rear walls 15, 16 of a display rack. A required length of the mounting rails is obtained either by cutting a modular length rail to the desired length or by positioning two or more of the modular length rails in end-to-end relationship. In positioning of the rails, the stock clerk will also position the rails such that the notches 38 in the vertical ribs 37 as between the front and rear rails will be aligned so as to coincide with the respective end walls 17 of adjacently positioned display racks 10. With the rails thus positioned and secured to the supporting shelf S, the several display racks 10 may then be easily positioned on the rails with their wall elements interfitting in the grooves or channels defined by the flange and ribs 36, 37 of the rail and the end walls extending through the notches 38. The mounting rails thus serve the function of maintaining the display rack on the shelf as well as assuring that the several display racks will be maintained in the desired linear array. Once the several display racks 10 are thus positioned on the respective mounting rails 11, the stock clerk may then place the required number of partition plates 30 in the display racks at the desired points to form the several compartments or sections of desired size for the particular display.

Figures 4, 5:
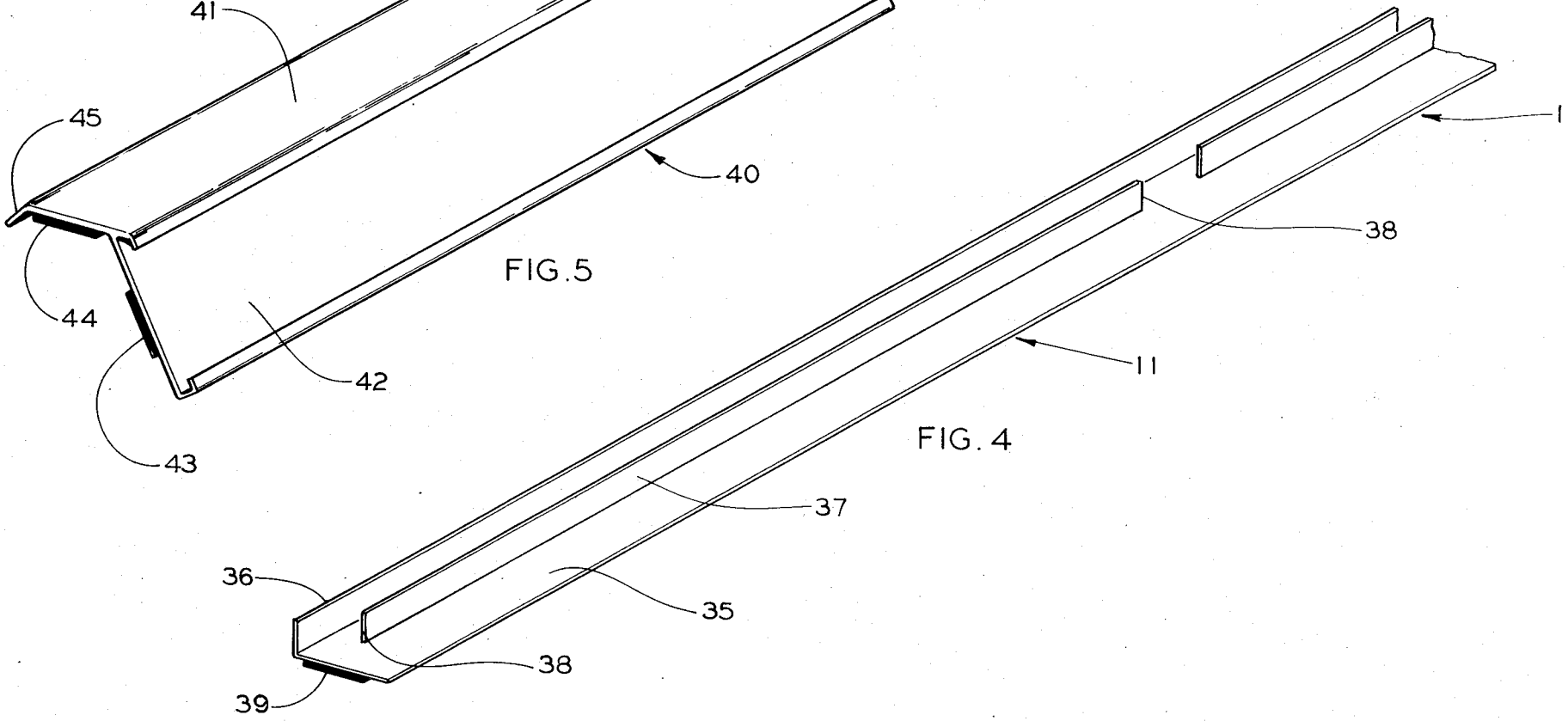
FIG. 4 is a perspective view of a fragmentary portion of one of the mounting rails.
FIG. 5 is a perspective view of a fragmentary portion of a connecting cover strip including a price and identifying rail.

To provide a more complete unitary appearance of the assembled modular display racks 10, it is desirable to also provide a front cover in the form of an elongated connecting cover strip 40 of extruded plastic that extends the length of the display. Again, this cover strip 40 is preferably of a modular length to extend over a predetermined number of the display racks. The cover strip 40 not only performs the function on mechanically connecting the several racks, but also functions as a cover at the front of the rack to conceal the small gaps between adjacent rack and is also designed to perform the function of a pricing rail to hold cards or inserts containing pricing or candle type identification. An illustrative configuration for the cover strip 40 is shown in fragmentary perspective view in FIG. 5 and installed in end view as seen in FIG. 2. The strip 40 is generally L-shaped in cross section having a top support plate 41 adapted to rest on the horizontal flange 23 at the front of the rack. Extending downwardly from the top support plate 41 is a channel shaped price rail 42 which is disposed at an angle with respect to the top support plate to overlie in parallel relationship the upper wall section 21 of the front wall. The cover strip 40 is readily secured in position by means of an elongated adhesive strip 43 which is similar in construction and fabrication as to the adhesive strips 39 secured to the bottom surface of the mounting rail. Also secured to the cover strip 40 is a strip of cushioning material 44 that is adhesively attached to the downwardly facing surface of the top support plate 41 and is adapted to overlie in contacting engagement with the upwardly facing surface of the flange 23. For a more complete finished appearance, the cover strip 40 is provided with an inner lip 45 that is carried at the rearwardly disposed edge of the top support plate 41 and extends in downwardly inclined relationship toward the rear of the display rack. This cover strip 40 is applied to the assembled array of display racks once they are positioned on their respective mounting rails 11. Installation is readily accomplished by first peeling off the protective layer of paper on the adhesive 43 and then merely positioning the cover strip onto the front of the display racks. When thus positioned, the cover strip thus extends over the spacing between the several racks for a more complete finished appearance and also functions to join the several display racks into a unitary assembly. Pricing information or other identification imprinted on paper strips or cards are readily inserted in the C-shaped price rail 42 as is well-known with price rail devices of this nature for merchandising displays.

The modular display racks 10 have been described as having a modular length of the order of one foot. Each of the racks is also of a dimensional configuration such that there is a front to back depth of the order of one foot with the vertical height of the rear wall being of the order of seven inches. The base support surface 13 in the illustrative embodiment has a length of the order of five inches and thus the racks will readily accommodate a large number of candles which may vary in length from the shortest sizes up to the relatively long ones in the order of 15 or 18 inch lengths. The article supporting wall 14 has sufficient vertical extent to provide adequate support for even the relatively tall candles. With the five inch width of the base support surface, it is also possible to position four or five layers of candles in any of the respective compartments or sections formed by respective pairs of the partition plates 30. While a specific dimensional configuration has been described for the illustrative embodiment, it will be apparent that these dimensions may be varied in accordance with particular preferences. For example, the display racks may be of a longer length and may have a lesser or greater front to back dimension to accommodate a desired number of layers or rows of candles on the display. Also, the vertical extent of the article supporting wall may be other than that described in accordance with the specific requirements as to candle lengths that will be displayed. Also, it will be understood that the mounting rails 11 may be of the modular length and cut to a desired length for a particular display or they may be of a length equivalent to each of the display racks.

It will be readily apparent form the foregoing detailed descriptions of an illustrative embodiment of the modular display rack system of this invention that a particularly novel display has been provided for articles of merchandise such as candles. The modular concept enables a display to be assembled to fit a particular retail store's requirements for the display of such articles. The display racks are of a configuration well adapted to position and maintain the elongated articles such as candles in an orderly visually pleasing arrangement that greatly faciitates the customer's viewing and comparison of the various types and styles of the candles. Additionally, the modular display rack system is economical to produce and is readily assembled and installed in the store environment. Providing of the partition plates and the frictional interference fitting of the plates in the grooves enables the stock clerk to readily rearrange and reorganize the display in accordance with the particular sales experience for the specific items that are displayed on the rack.

Having thus described this invention, what is claimed is:

1. A merchandise display system comprising a display rack of predetermined longitudinal extent having an article supporting surface adapted to receive and support thereon articles of merchandise of elongated, rod-shaped configuration is upstanding relationship on their bottom ends, said article supporting surface including a generally horizontally disposed base support surface and an article supporting wall projecting upwardly with respect to said base support surface with said base support surface and article supporting wall extending longitudinally of the rack and cooperatively defining an upwardly opening channel of V-shaped cross section, said article supporting wall being inclined with respect to a vertical plane in a direction away from said base support surface whereby elongated articles of merchandise positioned on said base support surface in upstanding relationship may repose against said article supporting wall, said base support surface and said article supporting wall having formed therewith a plurality of alternatingly disposed rib and groove conformations extending transversely thereacross to cooperatively engage with articles of merchandise positioned on said rack and restrain the merchandise against movement longitudinally of said rack, said grooves each being of a width less than the transverse dimension of the articles of merchandise to receive only a peripheral portion of the merchandise with respective ones of the grooves in said article supporting wall and said base support surface being longitudinally aligned, and at least two partition plates each having marginal edge portions thereof adapted to interfit in a selected groove and to be thereby supported in upright relationship to said article supporting surface and extending a predetermined distance therefrom to form a compartment between each two adjacent partition plates for retaining articles of merchandise therebetween, said rack including an elongated, upstanding front wall extending longitudinally in spaced relationship to said article supporting wall and having a plurality of rib and groove conformations formed therein in alignment with respective ones of the ribs and grooves of said article supporting wall and base support surface and adapted to mechanically interengage with said partition plates.

2. A merchandise display system according to claim 1 wherein said base support surface is formed with a plurality of transversely spaced and longitudinally extending notches adapted to interengage with the bottom ends of articles of merchandise positioned thereon and restrain the merchandise against movement transversely away from said article supporting wall.

3. A merchandise display system according to claim 1 wherein said grooves and plates are relatively dimensioned to form an interference fit therebetween whereby the partition plates will be retained in position by frictional engagement.

4. A merchandise display system according to claim 1 wherein said base support surface is inclined upwardly in a direction away from said article supporting wall to resist movement of articles of merchandise positioned thereon in a direction transversely away from said article supporting wall.

5. A merchandise display system according to claim 4 wherein said base support surface is inclined at an angle of the order of 15 degrees with respect to a horizontal plane.

6. A merchandise display system according to claim 1 wherein said article supporting wall is inclined at an angle of the order of 30 degrees with respect to a vertical plane.

7. A merchandise display system comprising a display rack of predetermined longitudinal extent having an article supporting surface adapted to receive and support thereon articles of merchandise of elongated configuration in upstanding relationship, said article supporting surface including a generally horizontally disposed base support surface and an article supporting wall projecting upwardly with respect to said base support surface with said base support surface and article supporting wall extending longitudinally of the rack and cooperatively defining an upwardly opening channel of V-shaped cross section, said article supporting wall being inclined with respect to a vertical plane in a direction away from said base support surface whereby elongated articles of merchandise positioned on said base support surface in upstanding relationship may repose against said article supporting wall, and mounting means adapted to be secured to a supporting structure in fixed relationship and to cooperatively interengage with said display rack for restraining said rack against transverse movement in a horizontal plane, said mounting means including at least one elongated mounting rail having coupling means for releasably interengaging with at least one display rack in mechanically interlocked relationship.

8. A merchandise display system according to claim 7 is of a length and having coupling means to releasably mechanically interengage with a plurality of said display racks in interlocked relationship for maintaining the racks in longitudinally aligned relationship.

9. A merchandise display system comprising a display rack of predetermined longitudinal extent having an article supporting surface adapted to receive and support thereon articles of merchandise of elongated configuration in upstanding relationship and upstanding wall elements connected with said article supporting surface in depending relationship for support thereof with said wall elements having bottom edge portions, said article supporting surface including a generally horizontally disposed base support surface and an article supporting wall projecting upwardly with respect to said base support surface with said base support surface and article supporting wall extending longitudinally of the rack and cooperatively defining an upwardly opening channel of V-shaped cross section, said article supporting wall being inclined with respect to a vertical plane in a direction away from said base support surface whereby elongated articles of merchandise positioned on said base support surface in upstanding relationship may repose against said article supporting wall, and mounting means adapted to be secured to a supporting structure in fixed relationship thereto and to cooperatively interengage with said display rack for restraining said rack against movement in a horizontal plane, said mounting means including at least one elongated mounting rail having coupling means for mechanically interengaging with said upstanding wall elements to restrain said display rack and including an elongated upwardly opening channel adapted to receive therein bottom edge portions of said wall elements in mechanically interlocked relationship.

10. A merchandise display system according to claim 9 wherein said mounting rail includes two upstanding flanges disposed in relatively spaced relationship and defining said channel, one of said flanges having at least one notch formed therein for cooperatively receiving a display rack wall element that is disposed in transversely extending relationship to the channel.

11. A merchandise display system according to claim 10 wherein said mounting rail is disposed to extend longitudinally with respect to said display rack and is of a length to cooperatively interengage with a plurality of said display racks disposed in longitudinally aligned relationship, said display rack having one of the wall elements thereof extending longitudinally to interfit in the channel of said rail and another wall element thereof extending transversely to interfit in a respective notch formed in a flange of said rail.

12. A merchandise display system according to claim 9 wherein said mounting means includes a downwardly facing surface provided with an adhesive material for securing said means to a supporting structure.

13. A merchandise display system according to claim 9 which includes an elongated connecting cover strip adapted to be disposed in longitudinally extending relationship with respect to a plurality of display racks positioned in longitudinally aligned relatinship and having connecting means adapted to cooperatively engage with each display rack disposed in coextensive relationship with said connecting cover strip.

14. A merchandise display system according to claim 13 wherein said display rack is formed with a front wall element extending longitudinally of the rack at the side of said base support surface opposite to said article supporting surface and said connecting cover strip is adapted to be secured to said front wall element of each display rack.

15. A merchandise display system according to claim 14 wherein the connecting means of said connecting cover strip is an adhesive.

16. A merchandise display system according to claim 14 wherein said connecting cover strip includes means for carrying of removable indicia at selected positions longitudinally therealong for identification of articles of merchandise positioned on a display rack in close proximity thereto.

17. A merchandise display system according to claim 1 wherein said base support surface includes merchandise retaining means disposed in a plurality of transversely spaced rows extending longitudinally of said display rack for mechanically interengaging with the bottom ends of the articles of merchandise to inhibit sliding movement of the articles of merchandise over said base support surface in a direction away from said article supporting wall.

18. A merchandise display system according to claim 17 wherein said base support surface is inclined upwardly in a direction away from said article supporting wall to resist movement of articles of merchandise positioned thereon in a direction transversely away from said article supporting wall.

19. A merchandise display system comprising a display rack of open-bottom, hollow-shell configuration and predetermined longitudinal extent having an article supporting surface adapted to receive and support thereby articles of merchandise of elongated configuration in upstanding relationship, said article supporting surface including a generally horizontally disposed base support surface and an article supporting wall projecting upwardly with respect to said base support surface with said base support surface and article supporting wall extending longitudinally of the rack and cooperatively defining an upwardly opening channel of V-shaped cross section, said article supporting wall being inclined with respect to a vertical plane in a direction away from said base support surface whereby elongated articles of merchandise positioned on said base support surface in upstanding relationship may repose against said article supporting wall, said article supporting surface formed as a wall and said display rack includes at least two upstanding wall elements connected with said article supporting surface wall in depending relationship thereto at opposite sides for support thereof and having bottom edge portions adapted to be positioned on a supporting structure, said opposed wall elements being relatively convergent in an upward direction to thereby result in a configuration adapted to at least partially receive another rack interiorly thereof whereby a plurality of said display racks are enabled to be stacked one upon another in nested relationship.

* * * * *